US006032986A

United States Patent [19]

Kennedy et al.

[11] Patent Number: 6,032,986

[45] Date of Patent: Mar. 7, 2000

[54] DOOR SYSTEM FOR A MINE STOPPING

[75] Inventors: William R. Kennedy; John M. Kennedy, both of Taylorville, Ill.

[73] Assignee: Jack Kennedy Metal Products & Buildings, Taylorville, Ill.

[21] Appl. No.: 09/052,322

[22] Filed: Mar. 31, 1998

[51] Int. Cl.[7] ..... E05C 3/06

[52] U.S. Cl. ..... 292/196; 292/58; 292/71; 292/66; 292/223; 292/DIG. 55

[58] Field of Search ..... 292/196, 57, 58, 292/71, 66, 223, 228, 221, 227, DIG. 71, DIG. 55

[56] References Cited

U.S. PATENT DOCUMENTS

| | | | |
|---|---|---|---|
| 1,298,272 | 3/1919 | Anderson . | |
| 1,300,796 | 4/1919 | White . | |
| 1,872,321 | 8/1932 | Moore . | |
| 1,938,267 | 12/1933 | Tufo | 292/196 |
| 2,741,505 | 4/1956 | Courney | 292/341.1 |
| 2,760,021 | 8/1956 | Cole et al. | 200/50 |
| 3,201,160 | 8/1965 | Lewin | 292/71 |
| 3,208,781 | 9/1965 | Appleberry | 292/228 |
| 4,003,614 | 1/1977 | Geer et al. | 312/320 |
| 4,021,073 | 5/1977 | Manning | 296/137 B |
| 4,082,331 | 4/1978 | Kennedy et al. | 292/228 |
| 4,118,894 | 10/1978 | Kennedy et al. | 49/402 |
| 4,230,351 | 10/1980 | Bisbing | 292/223 |
| 4,861,078 | 8/1989 | Munoz | 292/113 |
| 5,168,667 | 12/1992 | Kennedy et al. | 49/394 |
| 5,435,615 | 7/1995 | Schmitz | 292/121 |
| 5,775,140 | 7/1998 | Hallsten | 70/85 |

*Primary Examiner*—Darnell M. Boucher
*Assistant Examiner*—Clifford B. Vaterlaus
*Attorney, Agent, or Firm*—Senniger, Powers, Leavitt & Roedel

[57] ABSTRACT

A door system for closing a doorway in a mine stopping includes a door hinged adjacent the doorway for swinging relative to the stopping between a closed position and an open position. A keeper is mounted in fixed position relative to the doorway. A latch mechanism is cooperable with the keeper for latching the door in its closed position. The latch mechanism has a detent portion and is operable to move the detent portion between a latching position in which the detent portion engages the keeper for latching the door closed, and an unlatching position in which the detent portion is disengaged from the keeper for allowing the door to be opened. The latch mechanism is constructed and configured so that it operates to move the detent portion along a path defined at least in part by an arc centered on a point spaced away from the door whereby the detent portion is adapted to remain in substantial engagement with the keeper to maintain the door closed in the event the keeper moves relative to the door, as in a mine convergence.

15 Claims, 10 Drawing Sheets

3
26
44
42
32
64
66
20
52
114
34
22
116
60
80
79
86
86
78
110
86
81
64
86
70
98
66
90
72
33
48
26
3

225
201
227
215
203
217
203a
98
205
203b
209
33
70
26
22

DOOR SYSTEM FOR A MINE STOPPING

BACKGROUND OF THE INVENTION

This invention relates generally to doors for mine stoppings and, more particularly, to doors for use on masonry and metal mine stoppings.

So-called "stoppings" are widely used in mines to stop off the flow of air in passages in the mines, a "stopping" generally being a masonry (e.g., concrete block) or metal wall installed at the entrance of a passage to block flow of air therethrough. It is often desired that such stoppings be provided with a door for occasional access to the blocked-off passage. A problem is encountered, however, in providing a door for a stopping because the floors of passages in mines often heave up or otherwise shift (sometimes referred to as a "convergence"), which may result in the door becoming unlatched and opening up for undesired flow of air therethrough, or becoming jammed.

The door disclosed in applicants' U.S. Pat. No. 4,082,331, incorporated herein by reference, addresses the aforementioned problem in a generally satisfactory manner. The present invention represents an improvement with respect to the patented design.

SUMMARY OF THE INVENTION

Among the several objects of this invention may be noted the provision of an improved door system for a mine stopping, including an improved latch mechanism for holding a door of the system tightly closed during a mine convergence; the provision of such a door system wherein the latch mechanism requires less effort to operate, thereby facilitating latching and unlatching the door; and the provision of such a door system wherein the configuration of the latch mechanism can be engineered to provide the desired results according to the anticipated movement of various components of the system during a convergence.

Briefly, this invention is directed to a door system for closing a doorway in a mine stopping. The system includes a door hinged adjacent the doorway for swinging relative to the stopping between a closed position and an open position. A keeper is mounted in fixed position relative to the doorway. A latch mechanism is cooperable with the keeper for latching the door in its closed position. The latch mechanism has a detent portion and is operable to move the detent portion between a latching position in which the detent portion engages the keeper for latching the door closed, and an unlatching position in which the detent portion is disengaged from the keeper for allowing the door to be opened. The latch mechanism is constructed and configured so that it operates to move the detent portion along a path defined at least in part by an arc centered on a point spaced away from the door whereby the detent portion is adapted to remain in substantial engagement with the keeper to maintain the door closed in the event the keeper moves relative to the door, as in a mine convergence.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
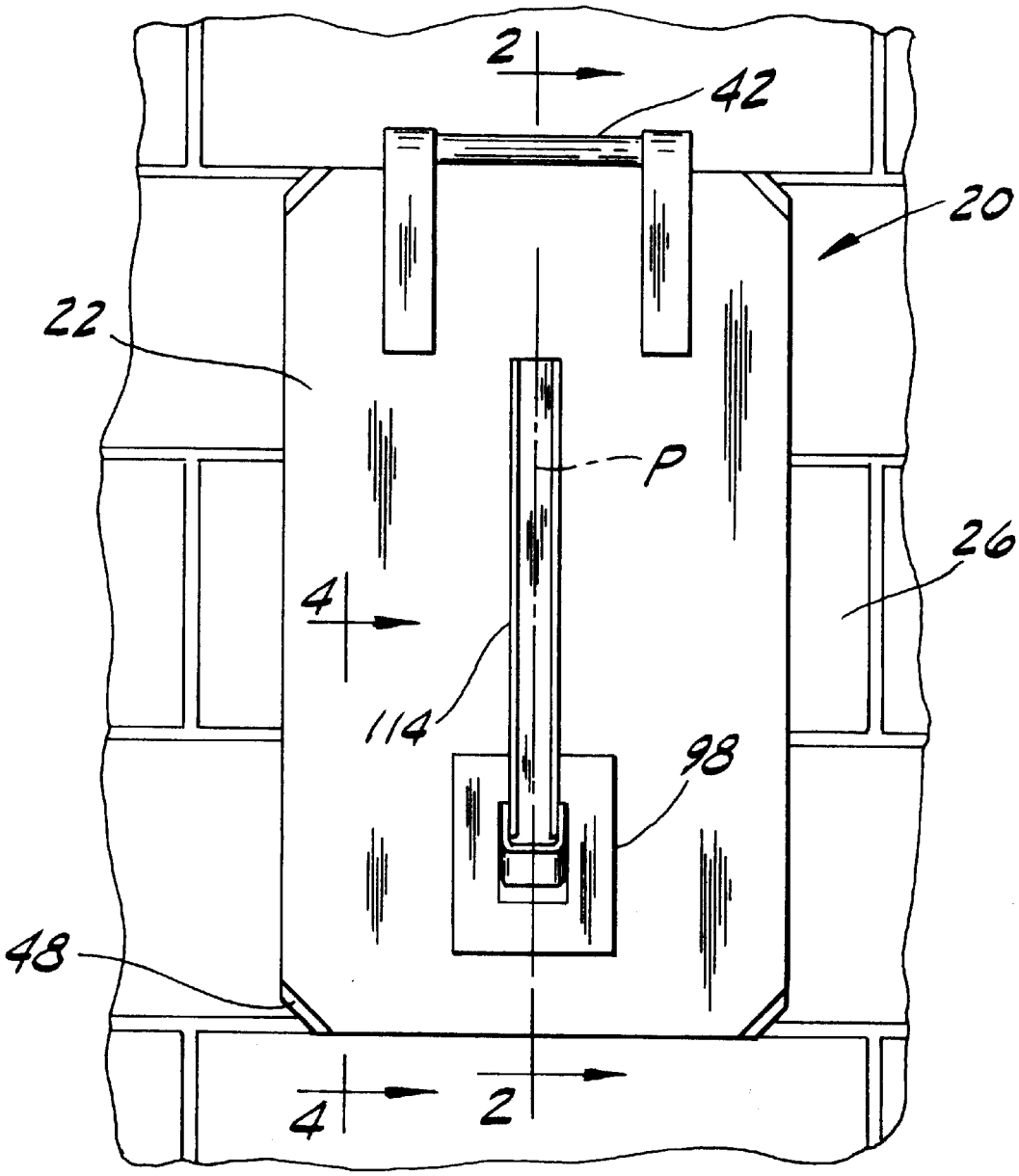
FIG. 1 is a front elevation of a door system of the invention installed in a masonry mine stopping.
Figure 2:
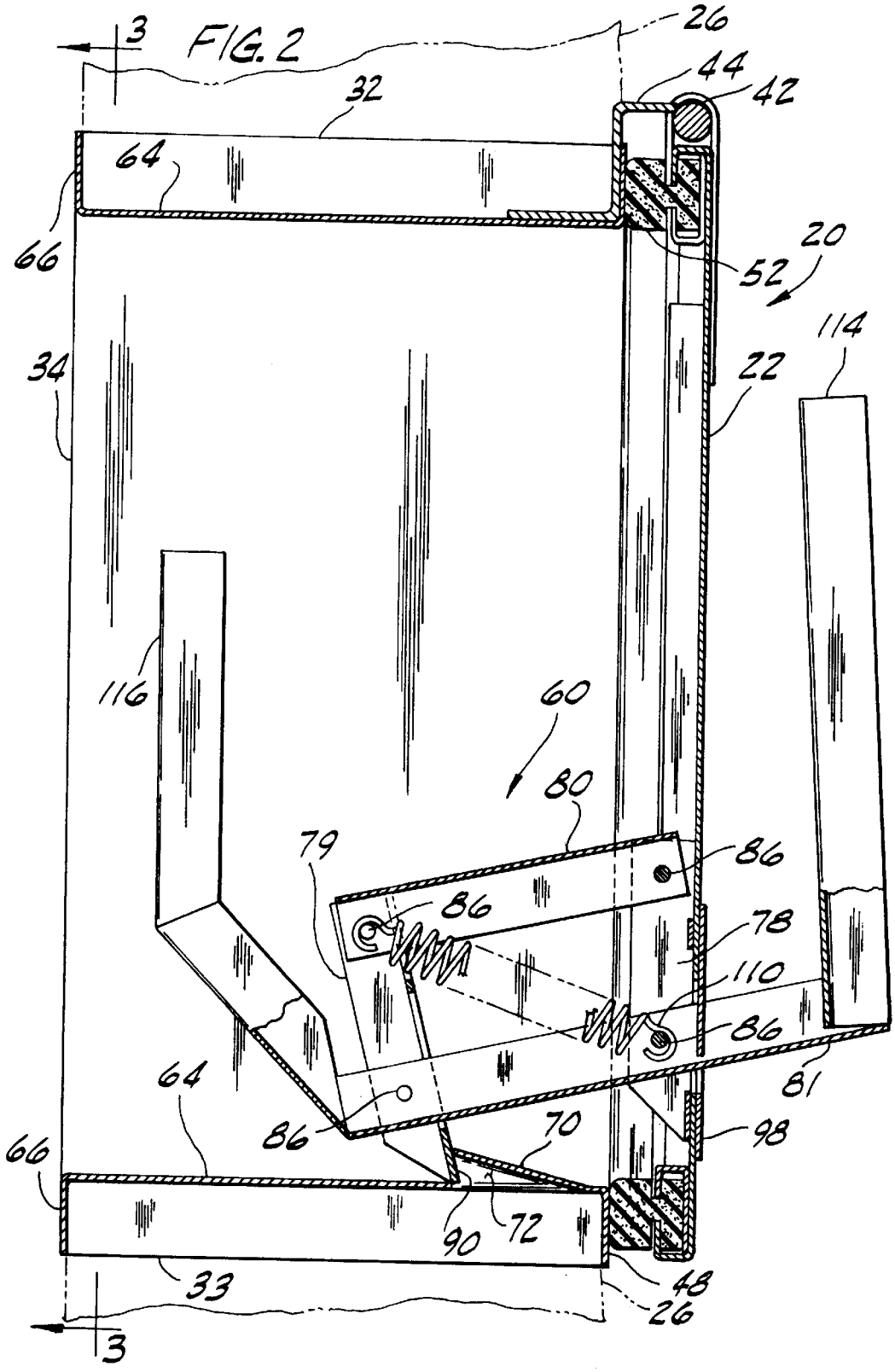
FIG. 2 is an enlarged vertical cross section taken in the plane of line 2—2 of FIG. 1 showing a latch mechanism of the door system in a latched position.
Figure 3:
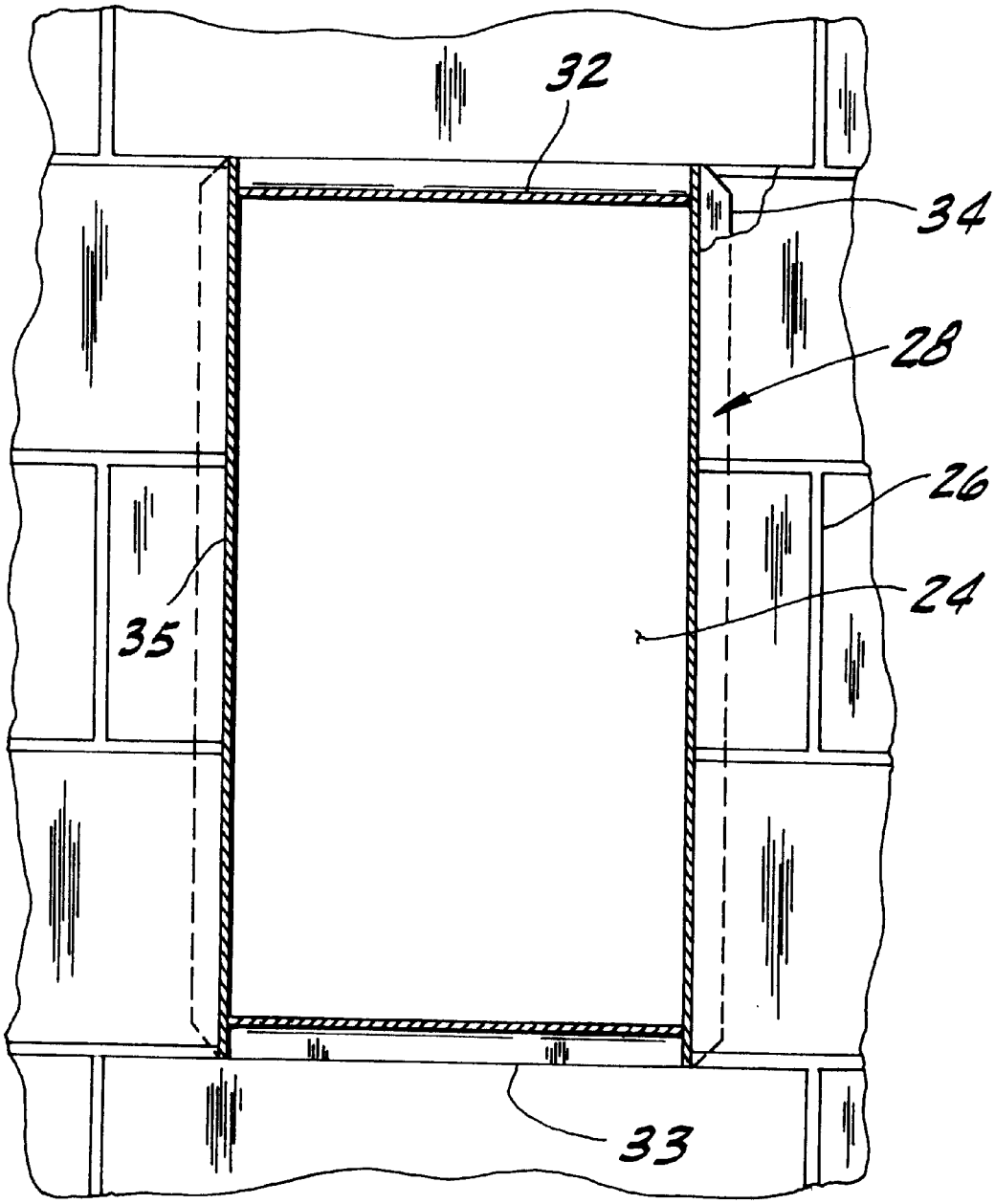
FIG. 3 is a vertical cross section taken in the plane of line 3—3 of FIG. 2.

Referring now to the drawings, FIGS. 1–3 show a door system of the present invention generally designated 20, for closing a doorway 24 in a mine stopping 26. The door system preferably includes a rectangular door frame, generally designated 28, and a door 22 hinged on the door frame. However, it is contemplated that the door may be hinged directly on the stopping 26 or otherwise attached around the doorway without including a door frame. The door frame 28 has opposing top and bottom horizontal frame members, designated 32 and 33, respectively, and two opposing vertical right and left side frame members, designated 34 and 35, respectively. The door 22 is supported at its upper end by a horizontal hinge pin 42 mounted on a bracket 44 secured to the top frame member 32. The door 22 swings on the hinge pin relative to the frame between a closed position (FIG. 2) engaging a face 48 of the frame around the doorway and an open position (FIG. 5) swung outwardly away from the frame. Preferably, a rubber seal 52 is attached to an inside face of the door 22 for engaging the face 48 of the door frame 28 all around the frame when the door 22 is closed. While the door 22 is preferably hinged along its top, it will be understood that the door may be hinged at its bottom or along one side. A latch mechanism, generally designated 60, is operable to latch the door 22 closed.

As illustrated in FIGS. 2 and 3, preferably each frame member 32–35 is in the shape of a channel having a relatively wide web 64 and a pair of opposing parallel flanges 66. The webs 64 of the four frame members 32–35 combine to define the rectangular doorway 24 through the stopping 26, and the flanges 66 of the four frame members combine to form continuous peripheral flanges which overlap the front and back faces of the stopping around the doorway. The bottom frame member 33 is preferably formed with a keeper 70 which slopes up from its web and angles away from the door 22. The keeper 70 is positioned near the door 22 for engagement by the latch mechanism 60. (The keeper 70 is often referred to in the trade as a "strike", and the latch mechanism 60 as a "bolt".) The keeper 70 is struck up from the web 64 so that an opening 72 facing away from the door is defined between the keeper and the web. The door frame 28 is sized to fit the masonry stopping 26 as shown, but it can also be readily sized to fit a metal stopping (not shown) having a lesser depth (i.e., thickness).

Figure 4:
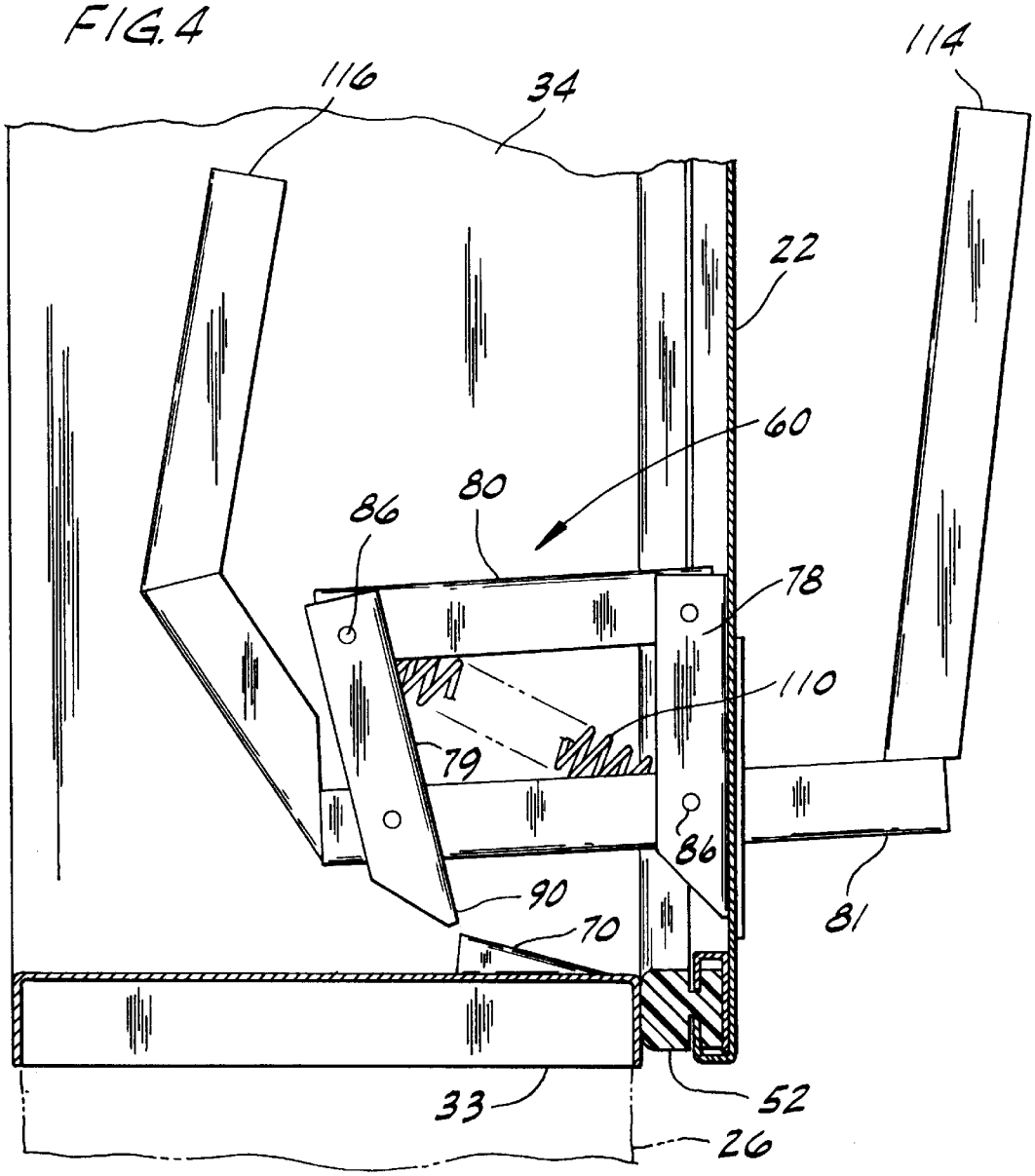
FIG. 4 is an enlarged fragmentary cross section taken in the plane of line 4—4 of FIG. 1 showing the latch mechanism in an unlatched position.

Referring to FIGS. 1–2 and 4, the latch mechanism 60 comprises a quadrilateral linkage which lies in a generally vertical plane P midway between opposite sides of the door 22 (FIG. 1). The linkage includes a first pair of opposing spaced-apart links (hereinafter referred to as a fixed link 78 and a detent link 79) and a second pair of opposing spaced-apart links (hereinafter referred to as an upper link 80 and a lower link 81) having pivot connections with the first pair of links. All four links 78–81 are preferably constructed of channel steel, although other designs are also possible. The fixed link 78 is affixed, as by welding, to the inside face of the door 22. The other links 79–81 are pivotally connected by pins 86 to form a quadrilateral linkage arrangement. The quadrilateral linkage may be a trapezoid (as shown) or may be a parallelogram or any another quadrilateral shape. The lower link 81 is connected toward its outward end to the fixed link 78 and adjacent its inward end to the detent link 79. The upper link 80 is connected adjacent its outward end to the fixed link 78 and adjacent its inward end to the detent link 79. The detent link 79 has an end portion which extends down from its connection with the lower link 81 and constitutes a detent portion 90 of the latch mechanism 60. The bottom surface 92 of this detent portion 90 is angled for clearance over the keeper 70 and the web 64 of the bottom frame member 33 as the door 22 is opened or closed, the result being that only a lowermost end or tip of the detent portion contacts the frame, thus reducing friction and the force required to open and close the door. Preferably, the lower link 81 of the latch mechanism 60 extends inwardly into the doorway 24 through an opening in an outer plate 98 affixed to the door 22, an opening in the door itself, and an opening in the fixed link. The upper edge of the opening in the outer plate 98 serves as a stop to restrict upward movement of the lower link 81. Alternatively, the latch mechanism 60 may be attached to the inside face of the door without extending through an opening in the door. In another alternative, the latch mechanism 60 may be attached to the stopping 26 or the frame 28, and the keeper 70 may be on the door.

As shown best in FIG. 2, the length of the lower link 81 between its connections to the fixed link 78 and detent link 79 is preferably shorter than the length of the upper link 80 between its connections to the fixed and detent links. Also, when the latch mechanism 60 is in its latching position, the upper and lower links 80, 81 extend inwardly from the door 22 preferably at a generally downward angle toward the keeper 70. As a result of this configuration, the detent link 79 in its latching position angles down and toward the door 22 so that the lower end or tip of the detent portion 90 projects into the keeper opening 72 for more securely holding the door closed. It will be understood that other configurations are possible, such as where the detent link 79 is at other angles relative to the frame.

Preferably, a coil spring 110 extends diagonally between opposite corners of the quadrilateral linkage for biasing the link 79 and its detent portion 90 toward its latching position. The spring 110 extends between the pin 86 connecting the upper link 80 and detent link 79 and the pin 86 connecting the fixed link 78 and lower link 81.

Figure 5:
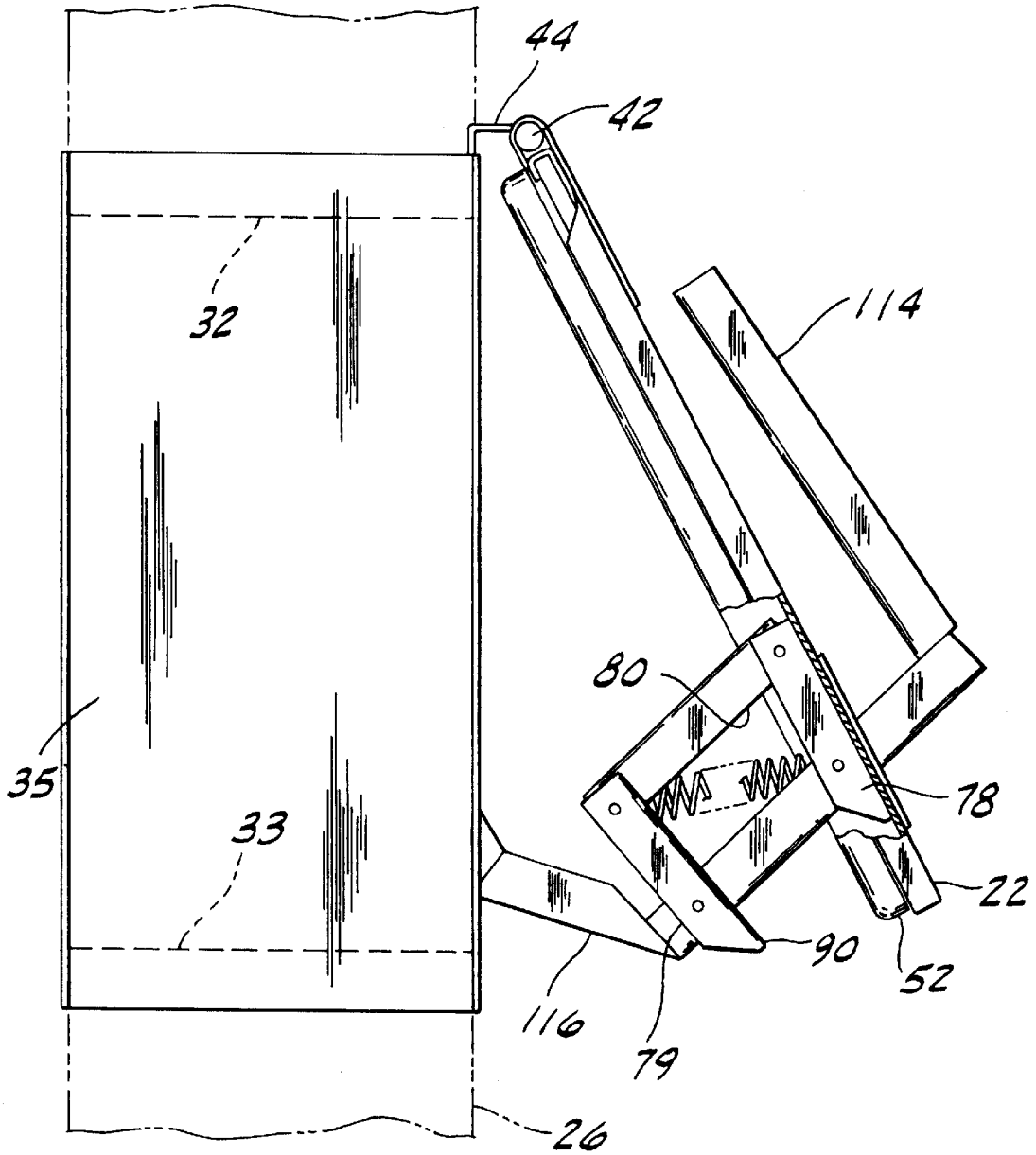
FIG. 5 is a side elevation showing the door in an open position, portions of the door being broken away to show details of the latch mechanism.

A first handle 114 is preferably attached to the lower link 81 adjacent its outer end and is spaced outward from the door 22. A second handle 116 is preferably attached to the lower link 81 adjacent its inner end and is spaced inward from the door. The handles 114, 116 are rigidly attached to the lower link 81, as by welding, but may also be made integral with the lower link. The handles 114, 116 are manually movable to operate the latch mechanism 60. To move the latch mechanism 60 from the latching position shown in FIG. 2, the first handle 114 is moved outward from the door 22 and downward, or the second handle 116 is moved toward the door and upward, causing the mechanism to rotate clockwise (as viewed in FIG. 2) and the detent portion 90 to move out of engagement with the keeper 70 into an unlatching position (FIG. 4). The coil spring 110 has an appropriate stiffness for allowing the handle to be moved with relatively light force on the handles 114, 116. From this position, the door 22 can be swung open (FIG. 5).

Figure 6:
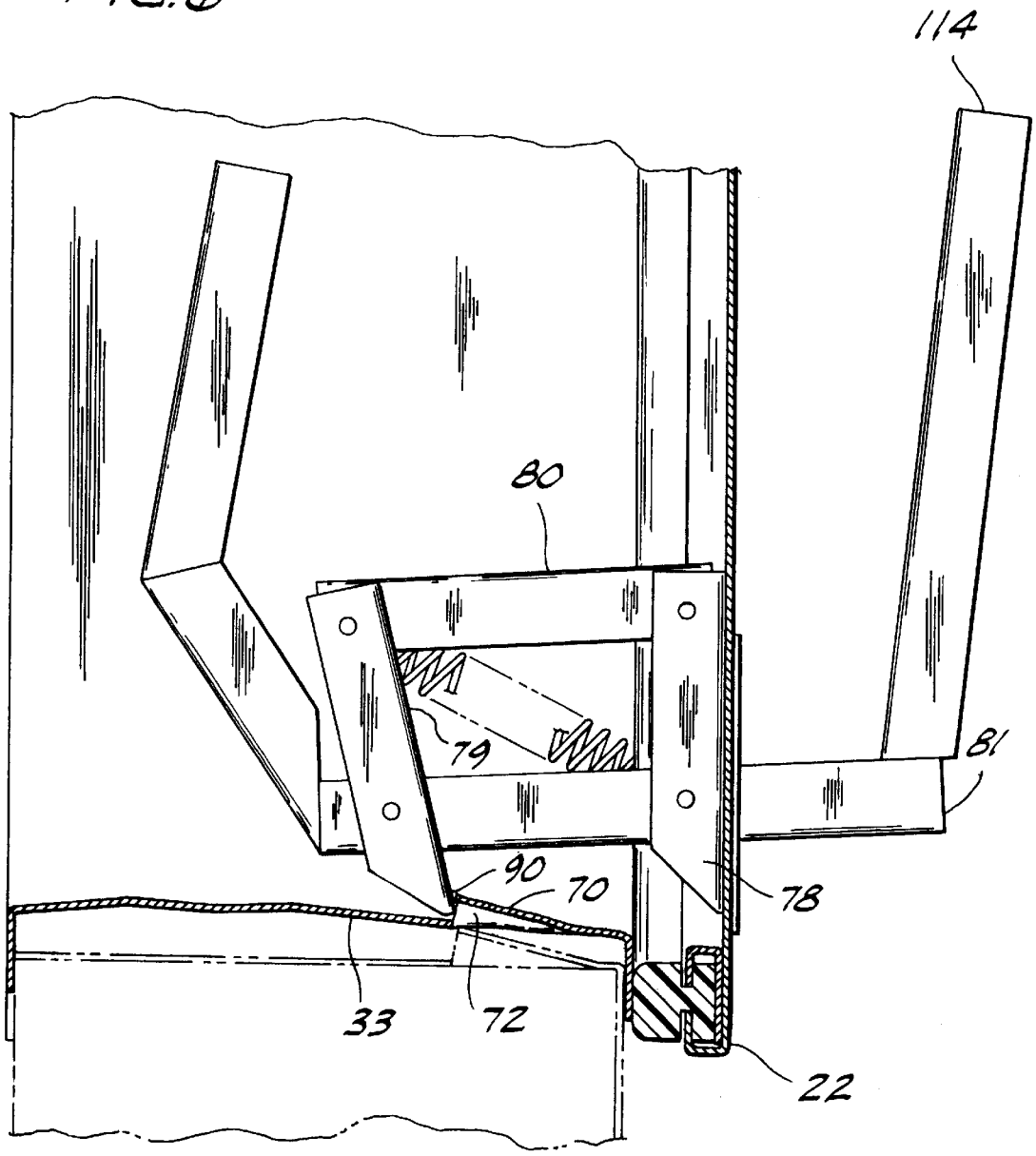
FIG. 6 is a fragmentary cross section similar to FIG. 4 showing the system in the latched position after a mine convergence.

In a mine convergence, the floor of a mine passage can heave up or otherwise shift, causing the top and bottom of the doorway 24 to converge toward one another. This convergence will typically cause the frame members 32–35 to deform and buckle, but not so much as to make the door 22 unusable. As illustrated in FIG. 6, a convergence has caused the bottom frame member 33 and keeper 70 to move in an upward path relative to the door 22 so that a distance between the keeper and a fixed point on the door changes. In prior designs, this change often caused the door to become unlatched or loose because the latch was unable to maintain a tight engagement with the keeper. The present latch mechanism 60 overcomes this problem because it is constructed and configured so that the detent portion 90 of the detent link 79 will remain in tight latching engagement with the keeper 70 even though there is a significant change in the position of the keeper. Experience has shown that the path followed by the keeper 70 during a mine convergence often takes the form of a shallow arc, although the exact configuration of the path will vary depending on various factors, such as the construction of the door frame, the stopping, any material used to seal the doorway, the type of strata, the rate of convergence, the effective vector of the convergence, the amount of convergence and the symmetry of the convergence with respect to the door and frame, among other factors. Taking these factors into account, the path of the keeper 70 during a convergence can be predicted with some reliability. Based on this information, the latch mechanism 60 of the present invention is engineered and configured so that, during a convergence, the latch mechanism will rotate in a clockwise direction and the detent portion 90 of the detent link 79 will move along a path (at least a portion of which is defined by arc A in FIG. 7) generally corresponding to the anticipated path of the keeper 70 so the separation between the keeper and the detent portion is kept to a minimum. Preferably, the path is defined at least in part by an arc (e.g., arc A) centered on a point 121 spaced away (e.g., outward) from the door. As a result, the detent portion 90 is maintained in tight engagement with the keeper 70 before, during and after the convergence so that the door 22 remains tightly closed at all times. The angle of the detent portion 90, as discussed above, helps to keep the detent portion within the keeper opening 72 so that it remains in tight engagement with the keeper 70. The relative length of the links 78–81 and the location of their pivot connections can be adjusted in order to change the path to match the anticipated path of the keeper 70 during the convergence. The path may also be changed by varying the initial height of the latch mechanism 201 relative to the keeper 70. The center of the arc may be spaced away from the door 22 a distance varying from an inch or less to an infinite distance, resulting in the path being essentially a straight line.

Also, as shown in FIG. 6, the distance between an uppermost end of the keeper 70 and the web 64 of the bottom frame member 33 may be shortened during a convergence. The latch mechanism 60, constructed and configured as described above, will maintain the door 22 tightly latched despite the shortened distance between the keeper 70 and the bottom frame member 33. The side frame members 34, 35 may also converge toward one another during a mine convergence. The mechanism 60 is such as to maintain the door 22 tightly latched, and allow it to be opened, upon relative lateral shifting of the frame 28, e.g., if the top frame member 32 moves laterally while the bottom frame member 33 remains stationary.

Figure 8:
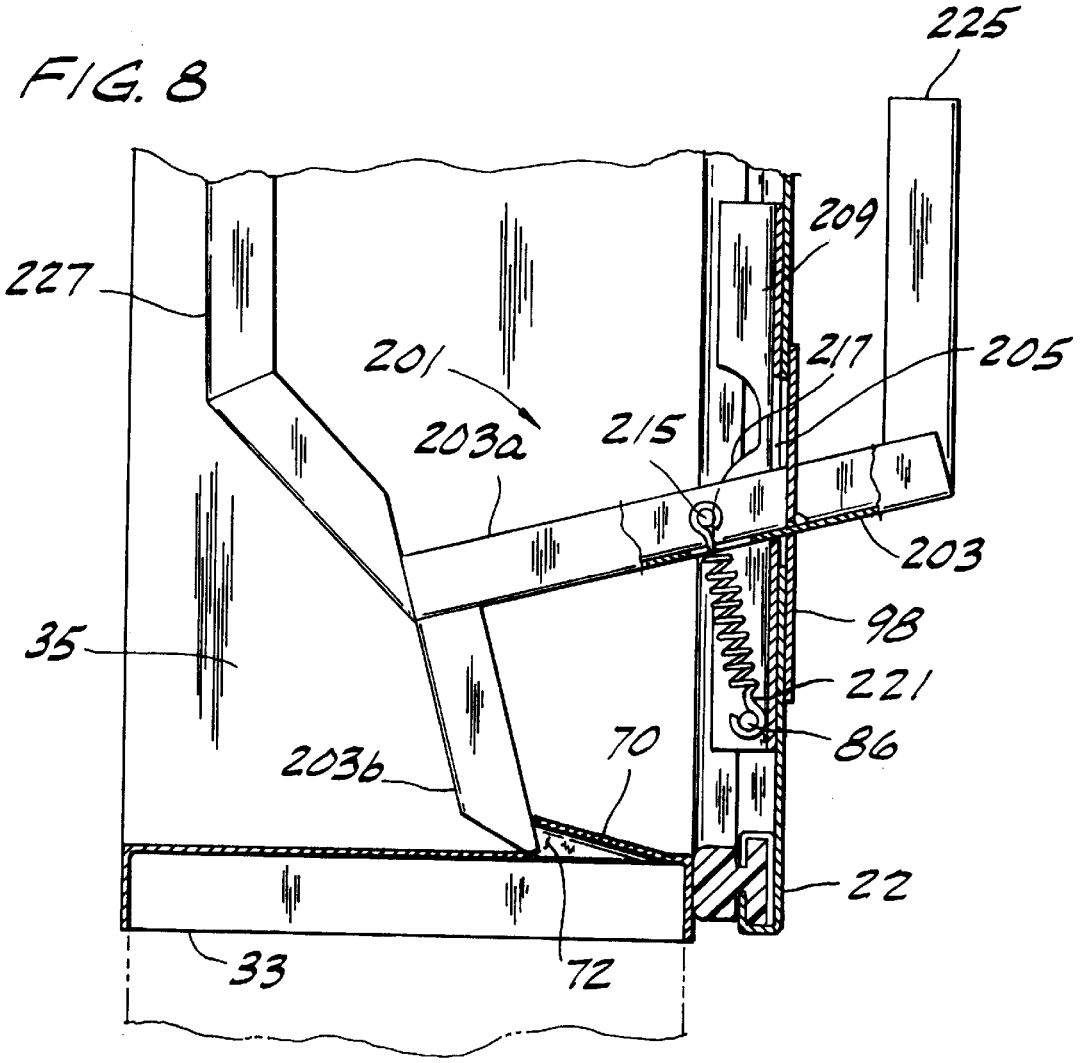
FIG. 8 a partial fragmentary cross section similar to FIG. 2 showing a second embodiment of the latch mechanism.
Figure 9:
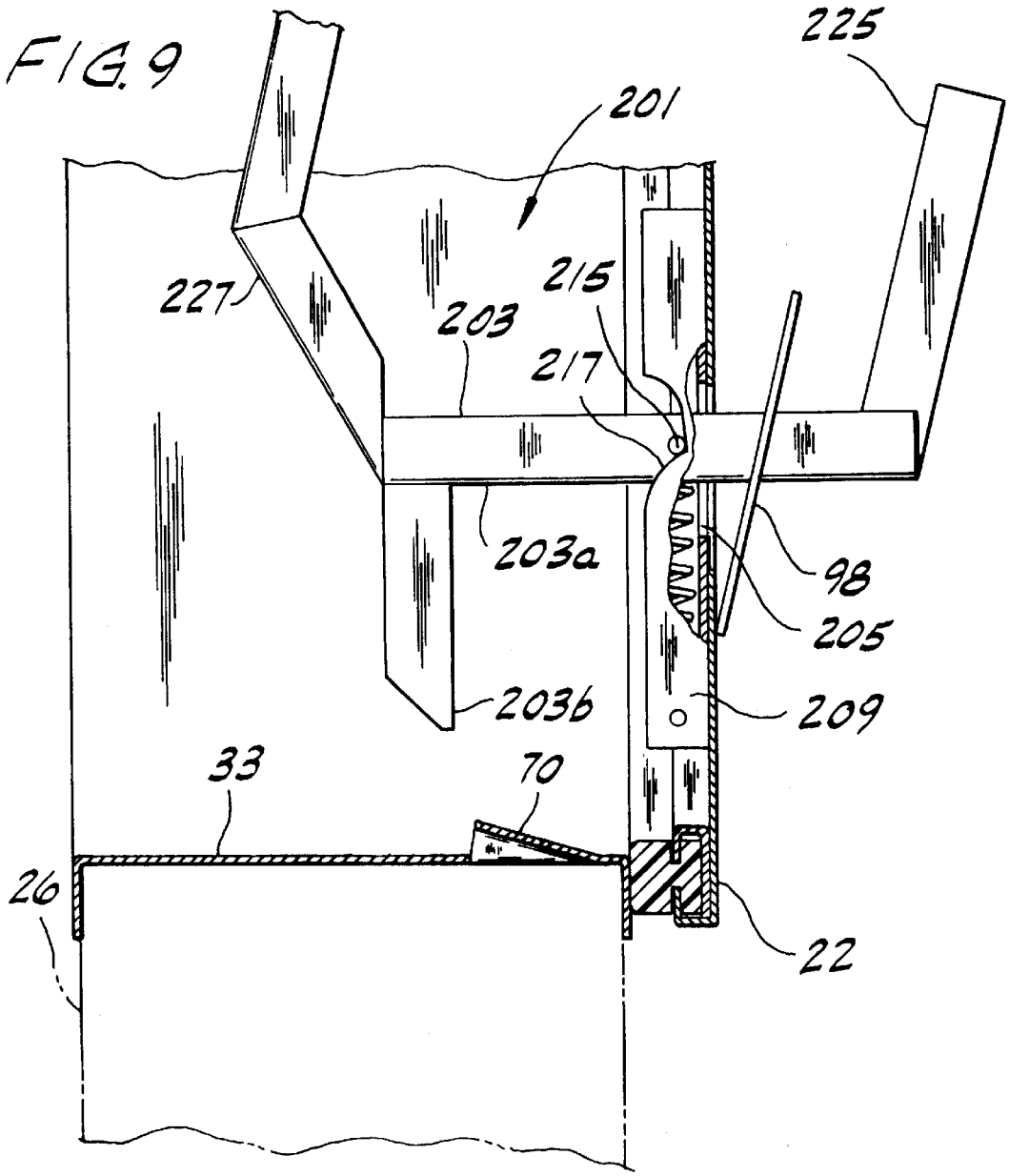
FIG. 9 is a partial fragmentary cross section showing the latch mechanism of FIG. 8 in an unlatched position.

Referring to FIG. 8, a second embodiment of the latch mechanism of the present invention is generally designated by the reference numeral 201. (The construction of the door 20, door frame 28 and keeper 70 is identical to that described above so these parts are designated by the same reference numbers.) The latch mechanism 201 comprises an L-shaped latch bar 203 having first and second legs 203*a* and 203*b* which lie in a generally vertical plane midway between opposite sides of the door 22. The first leg 203*a* of the latch bar 203 extends inwardly through the opening in the outer plate 98, the opening in the door 22 and an opening 205 in a cam 209 affixed to the inside face of the door 22. The latch bar 201 is preferably constructed of channel steel and is attached, as by welding, to the flat outer plate 98. Unlike the first embodiment, the outer plate 98 is not affixed to the door 22, but rather is movable relative to the door from the position shown in FIG. 8 where the plate lies flat against the outer face of the door when the latch bar 203 is in its latching position, to a position away from the door, as shown in FIG. 9, when the latch bar is in its unlatching position. When in its latching position, the first leg 203*a* of the latch bar 201 slopes generally downward as it extends inwardly through the door 22. The second leg 203*b* of the latch bar extends downwardly generally at right angles to the first leg 203*a* at the inner end of the leg 203*a*. Leg 203*b* constitutes a detent portion of the latch bar 201 and has a shape generally corresponding to that of the detent portion 90 of the detent link 79 of the first embodiment. Leg 203*b* slopes down and toward the door 22 when the latching mechanism 201 is in its latching position. Like the first embodiment, the lower end of the leg 203*b* of the latching bar is receivable in the keeper opening 72 to ensure that the door is held securely closed.

Figure 10:
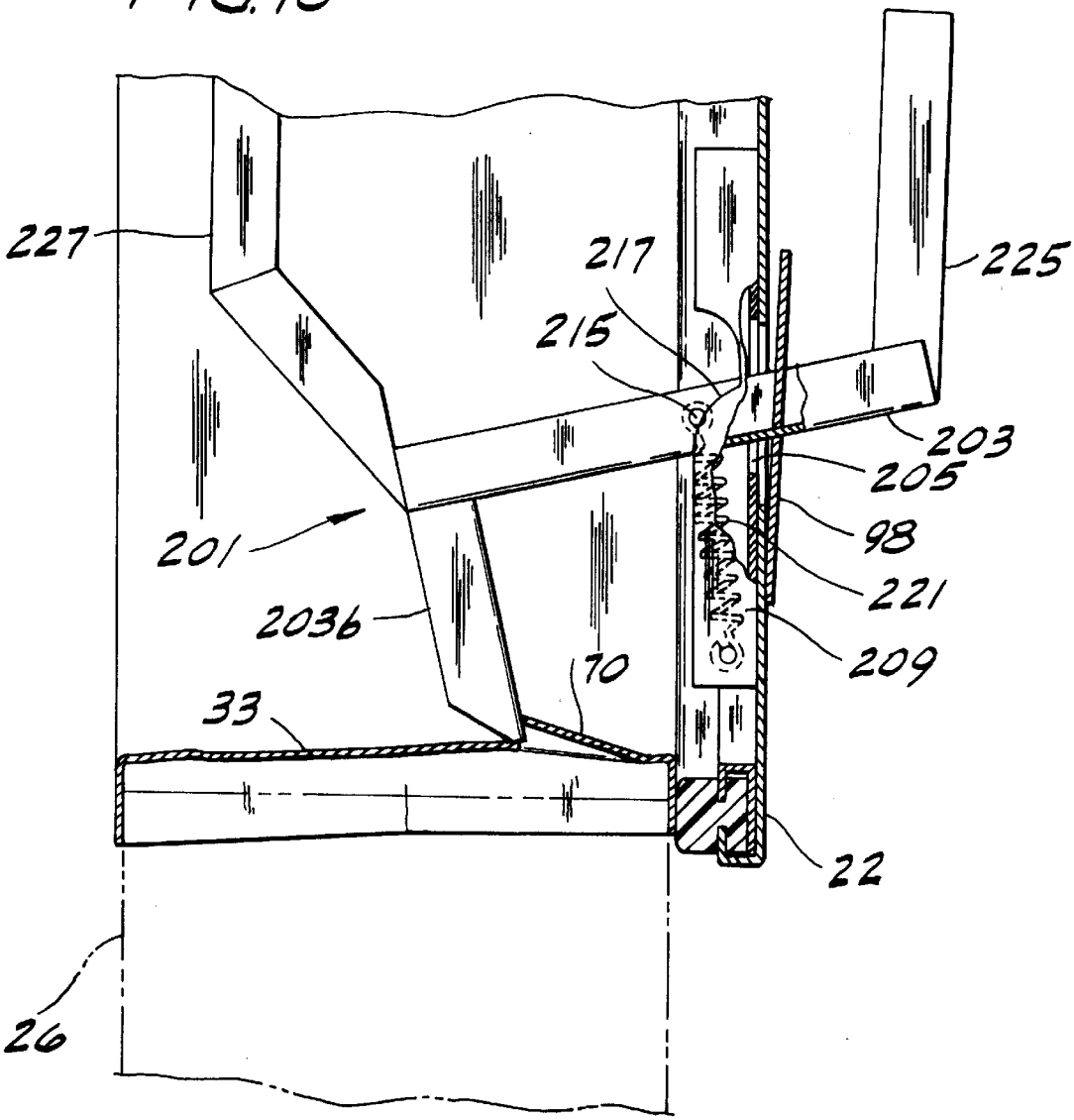
FIG. 10 is a partial fragmentary cross section showing the latch mechanism of FIG. 8 in a latched position after a mine convergence.

A follower in the form of a pin 215 extends through the side walls of the channel-shaped first leg 203*a* of the latch bar 203 and projects laterally from the latch bar for engagement with a contoured camming edge 217 on the cam 209. As shown in FIG. 10, a coil spring 221 is connected at its upper end to the follower pin, extends down through an opening in the first leg 203*a* of the latch bar, and is connected at its lower end to a pin on the cam 209. The spring maintains the follower pin 215 in engagement with the camming edge 217 of the cam 209 and urges the leg 203*b* of the latch bar 203 into engagement with the keeper 70.

Like the first embodiment, the latch bar 203 preferably has two handles 225 and 227, the first (225) being attached to the outer end of the first leg 203*a* of the latch bar, and the second (227) being attached to the inner end of the first leg 203*a*. The handles 225, 227 are rigidly attached to the latch bar 203, as by welding, but the handles can be made integral with the latch bar. The handles 225, 227 are manually movable in the same manner as the handles of the first embodiment to operate the latch bar 203. Moving either handle to rotate the latch bar in a clockwise direction as shown in FIG. 10 will cause the lower end of leg 203*b* to disengage the keeper 70 (FIG. 9), thereby allowing the door 22 to be swung up to its open position. Preferably, when the latch bar 203 is moved to its unlatching position, it pivots generally about the point of engagement between the follower pin 215 and the cam 209 and about the lower edge of the outer plate 98 which remains in contact with the outer face of the door 22 (FIG. 9).

Referring to FIG. 10, the latch mechanism 201, like mechanism 60 of the first embodiment, remains latched during a mine convergence since it is constructed and configured so that the lower end of leg 203*b* remains in tight latching engagement with the keeper 70 even though there is a significant change in the position of the keeper. The latch mechanism 201 is engineered and configured so that, during the convergence, the latch mechanism will rotate in a clockwise direction and the latch bar 203 will follow the contour of the camming edge 217, causing the lower end of leg 203*b* of the latch bar to move along a path generally corresponding to the anticipated path of the keeper 70 so the separation between the keeper and the detent portion is kept to a minimum. Preferably, the path of the lower end of leg 203*b* is defined at least in part by an arc (e.g., arc A in FIG. 7) centered on a point spaced away (e.g., outward) from the door. As a result, the spring 221 will maintain the lower end of leg 203*b* in engagement with the keeper 70 before, during and after the convergence so that the door 22 remains tightly closed at all times. The contour of the camming edge 217 can be adjusted in order to change the path to match the anticipated path of the keeper 70 during the convergence. The path may also be changed by varying the initial height of the latch mechanism 201 relative to the keeper 70. The center of the arc may be spaced away from the door 22 a distance varying from an inch or less to an infinite distance, resulting in the path being essentially a straight line.

Figure 7:
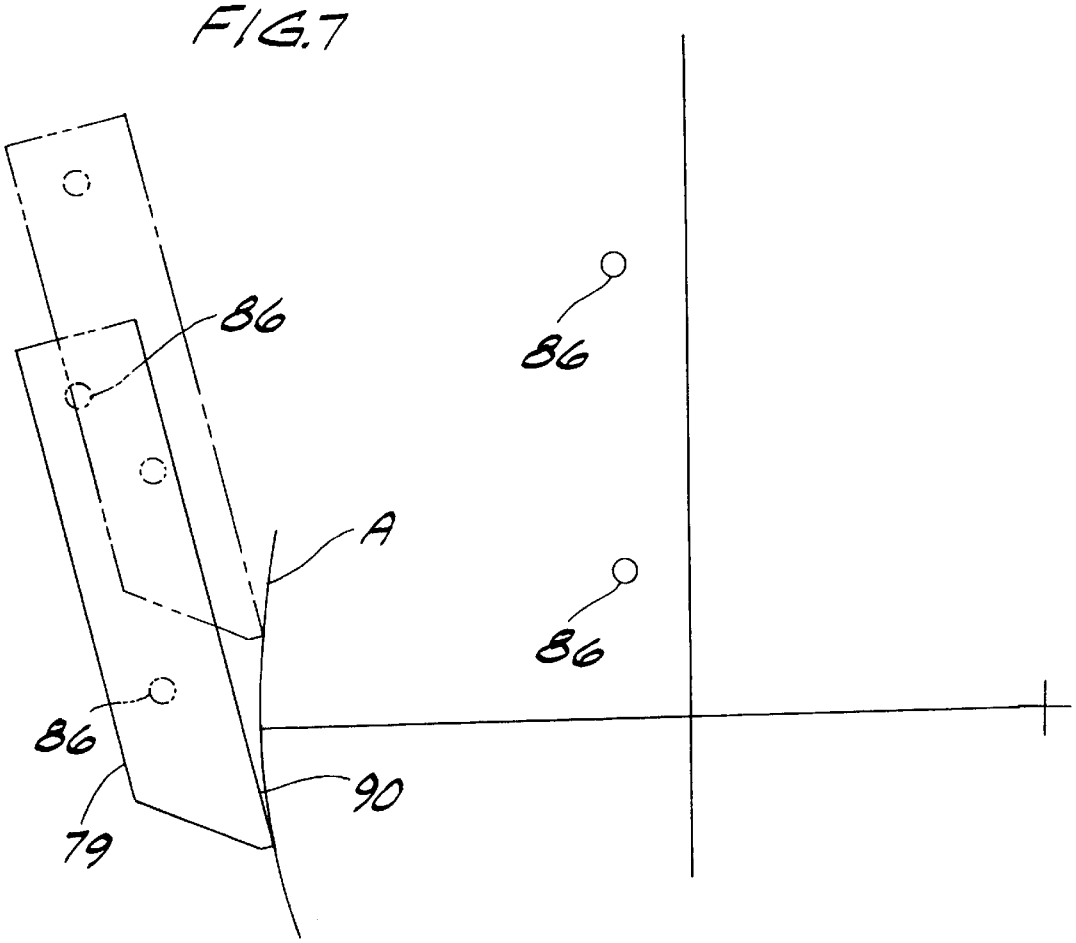
FIG. 7 is a diagram showing the path of movement of a detent portion of the latch mechanism.

As described above, the door system of the present invention has several advantages over prior art systems. For instance, the latch disclosed in U.S. Pat. No. 4,082,331 is not as effective in maintaining the door closed during a mine convergence. The prior latch pivots about a single point on the door, which causes the arc defining the path of the latch to be too severe to effectively follow the path of the keeper in a mine convergence. The latch mechanisms 60, 201 are more effective during a mine convergence because the paths of the detent portions 90, 203*a* are defined at least in part by an arc centered on a point spaced outward from the door. This arc, as shown in FIG. 7, is flatter and more shallow than the prior design and more closely follows the anticipated path of the keeper. Thus, the latch mechanisms of the present invention are more effective to keep the detent portion in engagement with the keeper even though the keeper moves vertically relative to the door. Moreover, the path of the detent portion of each mechanism 60, 201 can be designed according to the anticipated path of the keeper, regardless of what the path may be. The path of detent portion 90 of the latch mechanism 60 can be varied, among other ways, by changing the lengths of the links and/or the locations of the pins 86, and the path of latch mechanism 201 can be varied, among other ways, by changing the profile of the camming edge 217.

The present invention is also an improvement over prior designs which use heavy springs having relatively high stiffness to bias the latch closed. The heavy springs make the latches hard to operate. The geometries of the latch mechanisms 60, 201 of this invention require less force to bias the mechanisms to the latching position, so lighter springs 110, 221 may be used. As a result, operation of the latch mechanisms 60, 201 is relatively easy compared to prior designs. Also, the geometry of prior latches causes some of the operating force to be directed back into the keeper, further increasing the force required to unlatch the door. The geometry of each of the latch mechanisms 60, 201 of the present invention reduces the required operating force by causing the respective detent portion 90, 203*a* to be directed away from the keeper as the latch mechanism pivots to the unlatching position.

The two embodiments disclosed above are merely illustrative. Many variations of the door system are possible without departing from the scope of the invention. For instance, the door may be mounted in a doorway without the frame disclosed above. The latch mechanism may also be mounted entirely on one face of the door without the link or latch bar extending through the door. Further, the positions of the latch mechanism and keeper may be reversed, such that the latch mechanism is mounted on the stopping or the frame, and the keeper mounted on the door. Finally, the mechanism need not include a spring, and will function very well without a spring if the detent portion is angled with respect to the keeper, as discussed above.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A door system for closing a doorway in a mine stopping, said door system comprising:

a door hinged adjacent the doorway for swinging relative to the stopping between a closed position and an open position swung outwardly away from the stopping, a keeper mounted in fixed position relative to the doorway, and latch means cooperable with the keeper for latching the door in its closed position, said latch means having a detent portion, said latch means being operable to move the detent portion between a latching position in which the detent portion engages the keeper for latching the door closed, and an unlatching position in which the detent portion is disengaged from the keeper for allowing the door to be opened, said latch means comprising a quadrilateral linkage constructed and configured so that it operates to move said detent portion along a path defined at least in part by an arc centered on a point spaced away from the door on a side of the door opposite from the detent portion whereby the detent portion of the latching means is adapted to remain in substantial engagement with the keeper to maintain the door closed in the event the keeper moves relative to the door, as in a mine convergence.

2. A door system as set forth in claim 1 wherein said latch means is mounted on the door.

3. A door system as set forth in claim 2 wherein said latch means comprises a quadrilateral linkage which includes a first pair of opposing spaced-apart links and a second pair of opposing spaced-apart links having pivot connections with said first pair of links, a first link of the first pair being affixed to the door and a second link of the first pair being spaced inward of the first link and having an end portion which constitutes said detent portion of the latch means.

4. A door system as set forth in claim 3 further comprising a rectangular door frame adapted to be mounted in the doorway, said door frame including a first pair of opposing door frame members and a second pair of opposing door frame members, wherein said door is hinged on the door frame and said keeper is on one of said door frame members.

5. A door system as set forth in claim 3 wherein the keeper defines a keeper opening and the detent portion of the second link of the first pair of links is configured to be received in the keeper opening when the door is latched closed for more securely holding the door closed.

6. A door system as set forth in claim 3 further comprising a spring system biasing said detent portion toward its said latching position.

7. A door system as set forth in claim 6 wherein said spring system comprises a spring attached to the pivot connections at opposite corners of said quadrilateral linkage.

8. A door system as set forth in claim 3 wherein said latch means further comprises at least one handle extending from a first link of the second pair of links that is pivotally connected to said second link of the first pair having said detent portion, said handle being manually movable to operate the latch means.

9. A door system as set forth in claim 8 wherein the handle is attached to the first link of the second pair of links adjacent an outer end thereof spaced outward from the door.

10. A door system as set forth in claim 3 wherein said two links of the second pair of links are of different lengths.

11. A door system as set forth in claim 10 wherein a first link of the second pair of links is shorter than a second link of the second pair of links, and wherein the first and second links of the second pair of links angle generally downward as they extend inwardly from the door when the door is latched closed.

12. A door system as set forth in claim 8 wherein said latch means further comprises first and second handles extending from a first link of the second pair of links, said handles being manually movable to operate the latch mechanism, said first handle being attached to the first link adjacent an outer end thereof positioned on the side of the door opposite from the detent portion, said second handle being attached to the first link at an inner end adjacent the detent portion.

13. A door system for closing a doorway in a mine stopping, said door system comprising a door hinged adjacent the doorway for swinging relative to the stopping between a closed position and an open position swung outwardly away from the stopping, a keeper mounted in fixed position relative to the doorway, and a convex quadrilateral linkage cooperable with the keeper for latching the door in its closed position, said quadrilateral linkage having a detent portion, said quadrilateral linkage being operable to move the detent portion between a latching position in which the detent portion engages the keeper for latching the door closed, and an unlatching position in which the detent portion is disengaged from the keeper for allowing the door to be opened, said convex quadrilateral linkage comprising four links having four pivotal connections, the pivotal connections being positioned at four corners of a four-sided convex formation when the linkage is in said latching and unlatching positions, said quadrilateral linkage being constructed and configured so that it operates to move said detent portion along a path to remain in substantial engagement with the keeper to maintain the door closed in the event the keeper moves relative to the door, as in a mine convergence.

14. A door system as set forth in claim 13 wherein the quadrilateral linkage has a generally trapezoidal shape.

15. A door system for closing a doorway in a mine stopping, said door system comprising a door hinged adjacent the doorway for swinging relative to the stopping between a closed position and an open position swung outwardly away from the stopping, a keeper mounted in fixed position relative to the doorway, a quadrilateral linkage cooperable with the keeper for latching the door in its closed position, said quadrilateral linkage having a detent portion, said quadrilateral linkage being operable to move the detent portion between a latching position in which the detent portion engages the keeper for latching the door closed, and an unlatching position in which the detent portion is disengaged from the keeper for allowing the door to be opened, said quadrilateral linkage comprising a first pair of opposing spaced-apart links and a second pair of opposing spaced-apart links having pivot connections with said first pair of links, and a spring system biasing said detent portion toward its said latching position, said spring system comprising a spring attached to the pivot connections at opposite corners of said quadrilateral linkage.

* * * * *